United States Patent [19]

Morgan

[11] Patent Number: 4,889,265

[45] Date of Patent: Dec. 26, 1989

[54] FOLDING PANT HANGER

[75] Inventor: Donald F. Morgan, Zeeland, Mich.

[73] Assignee: Batts, Inc., Zeeland, Mich.

[21] Appl. No.: 351,588

[22] Filed: May 15, 1989

[51] Int. Cl.[4] ..... A47G 25/48

[52] U.S. Cl. ..... 223/96

[58] Field of Search ..... 223/85, 87, 90, 91, 223/95, 96, 97

[56] References Cited

U.S. PATENT DOCUMENTS

| | | | |
|---|---|---|---|
| 2,535,521 | 12/1950 | Schoepfer | 223/96 |
| 3,055,565 | 9/1962 | Hollingsworth | 223/91 |
| 3,462,068 | 8/1969 | Suominen | 223/85 X |

*Primary Examiner*—Werner H. Schroeder
*Assistant Examiner*—David K. Suto
*Attorney, Agent, or Firm*—Price, Heneveld, Cooper, DeWitt & Litton

[57] ABSTRACT

A molded plastic garment hanger has a pair of parallel bars joined by straps at each end. The bars, in unfolded position, are vertically spaced, permitting a garment to be draped over the lower one of the bars for display and to be clamped between the two bars for transport when the lower one is folded up into a position parallel to the upper bar. Means are provided for latching the bars together when they are folded together to positively clamp a garment between them as for transport.

12 Claims, 3 Drawing Sheets

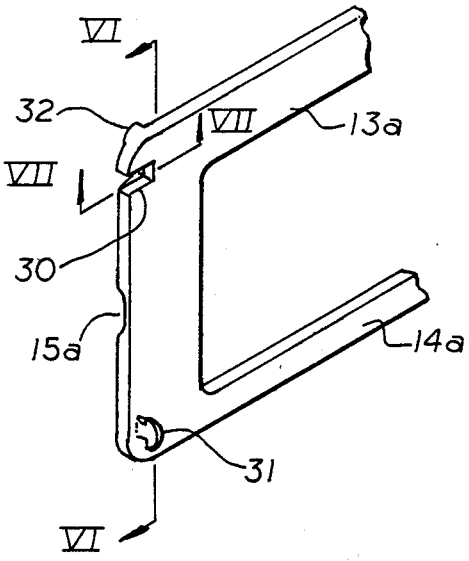
FIG. 5
FIG. 7
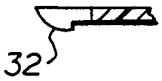
FIG. 6
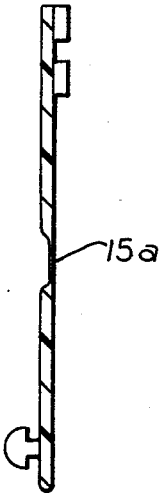
FIG. 8
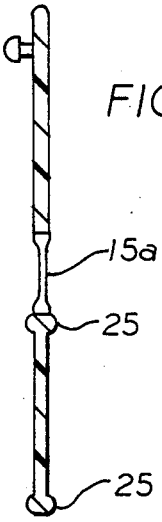
FIG. 11
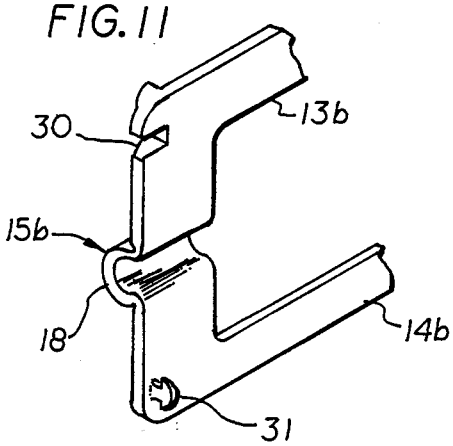
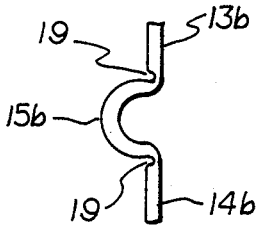
FIG. 12

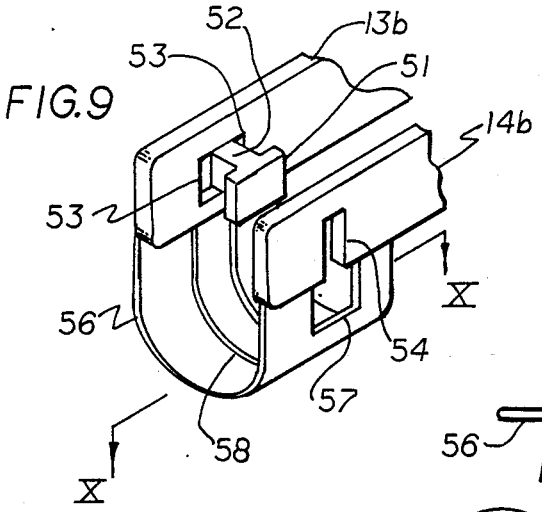
FIG. 9
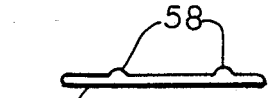
FIG. 10
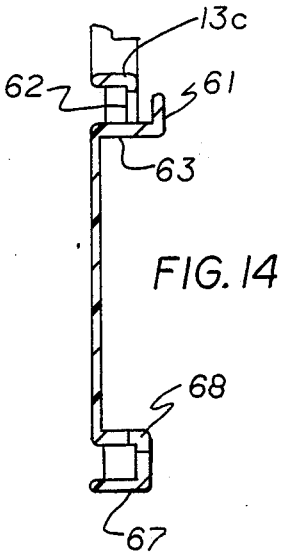
FIG. 14
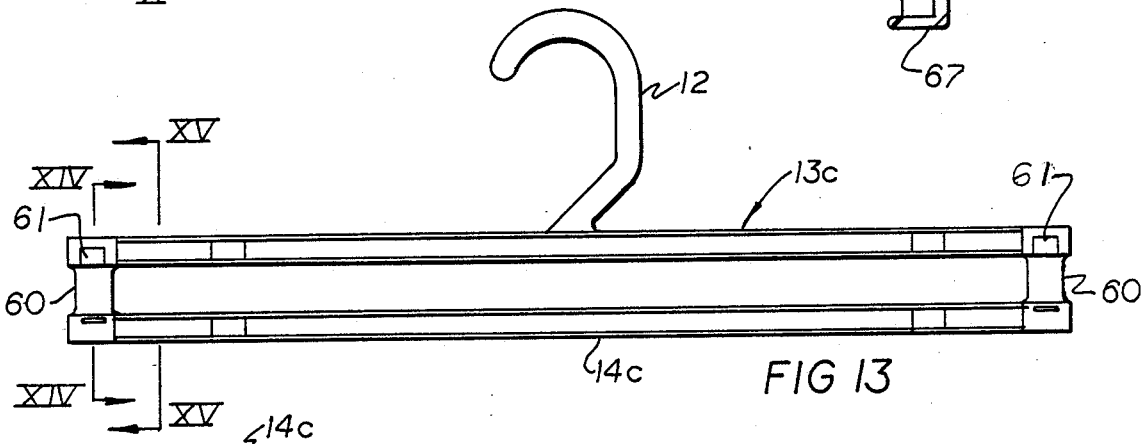
FIG 13
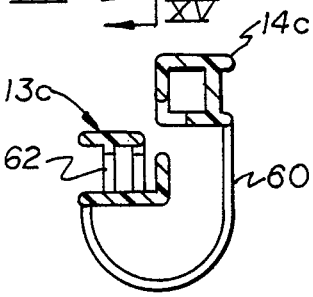
FIG. 15
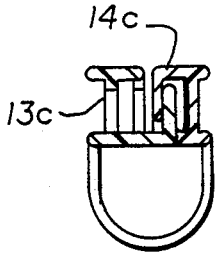
FIG. 16
FIG. 17
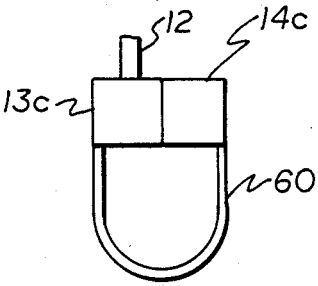

FOLDING PANT HANGER

SUMMARY OF THE INVENTION

This invention relates to garment hangers and more particularly to hangers for slacks, pants or the like, of the type having an integral, U-shaped bar over which the garment can be draped and then the bar folded up against the hanger body to positively clamp the garment.

BACKGROUND OF THE INVENTION

Various garment hangers have been devised over which a garment, such as a pair of slacks, can be draped and then the bar over which the garment is draped latched to the hanger body to clamp the garment. Examples of hangers of this construction are disclosed in U.S. Pat. Nos. 4,177,908, issued Dec. 11, 1979, to J. H. Batts et al. and 4,556,158, issued Dec. 3, 1985, to R. O. Blanchard et al.

All of these hangers are so constructed that the garment must be clamped to retain it. For many uses, such as retail display, it is frequently desirable to avoid clamping because this eliminates a possible source of irritation of the potential customer. This invention solves that problem by eliminating the necessity for clamping the garment when clamping is either unnecessary or undesirable.

Another aspect which is significant to hanger design is that the same hanger may be used both for retail display and for shipment of the garment from manufacturer to retailer. In garment shipment, positively securing the garment to the hanger is a necessity. Transport conditions require the application of some type of means to prevent unintended garment release. This invention provides a hanger which functions effectively both for transport and for retail display without compromising its functionality under either circumstance.

A further necessity for acceptability of hangers designed for the commercial market, that is, for use by retailers and clothing manufacturers, is low cost. Many hangers are provided by the manufacturer as a means of shipping the garments to the retail customer. This is attractive to the retailer because the garments are received in good condition. This saves the labor, cost and delay of preparing the garment for display, such as by pressing. Garments shipped on properly designed and manufactured hangers can be placed on display immediately upon receipt from the manufacturer. This is an attractive cost-effectiveness for the retailer and a selling point for the manufacturer. However, to be cost effective, it is necessary that the cost of the hanger be held to a minimum because the hangers preferably should not have to be returned by the retailer because such a procedure absorbs all or a substantial portion of the retailer's cost and labor saving benefits arising from the use of such hangers. Also, the hanger should be lightweight and easy to use.

BRIEF SUMMARY OF THE INVENTION

The invention provides a molded plastic one-piece garment hanger which can be used as a simple display hanger with the garment draped over a bar supported on both ends. By folding, it can be transformed into a shipping hanger capable of positively clamping the garment to prevent inadvertent release. The hanger can be molded in a simple, two part mold using minimal material since the folding for use during shipment reinforces the hanger to meet the additional strength required by such use.

BRIEF DESCRIPTION OF THE DRAWINGS

FIG. 5 is a fragmentary oblique end view of a modified construction for the hanger;

FIG. 6 is a sectional elevation view taken along the plane VI—VI of FIG. 5;

FIG. 7 is a fragmentary sectional view taken along the plane VII—VII of FIG. 5;

FIG. 8 is a sectional elevation view taken along the plane VIII—VIII of FIG. 1 but illustrating a modification of the lower bar;

FIG. 9 is a fragmentary, oblique, front view of a further modification of the hanger;

FIG. 10 is a sectional view taken along the plane X—X of FIG. 9;

FIG. 11 is a fragmentary, oblique, end view of another modification of the invention;

FIG. 12 is a fragmentary end view of the hinge illustrated in FIG. 11;

FIG. 13 is a front view of a further modification of this invention, illustrating the hanger in open position;

FIG. 14 is an enlarged sectional view taken along the plane XIV—XIV of FIG. 13;

FIG. 15 is a sectional view taken along the same plane as FIG. 14 but showing the bar in unlatched but ready to be latched position;

FIG. 16 is an enlarged, sectional view taken on the same plane of FIG. 15, illustrating the hanger in folded and latched position;

FIG. 17 is an end view of the hanger illustrated in FIG. 16; and

FIG. 18 is an end view of the hanger illustrated in FIG. 16 when it is open.

DESCRIPTION OF THE PREFERRED EMBODIMENT

Figure 1:
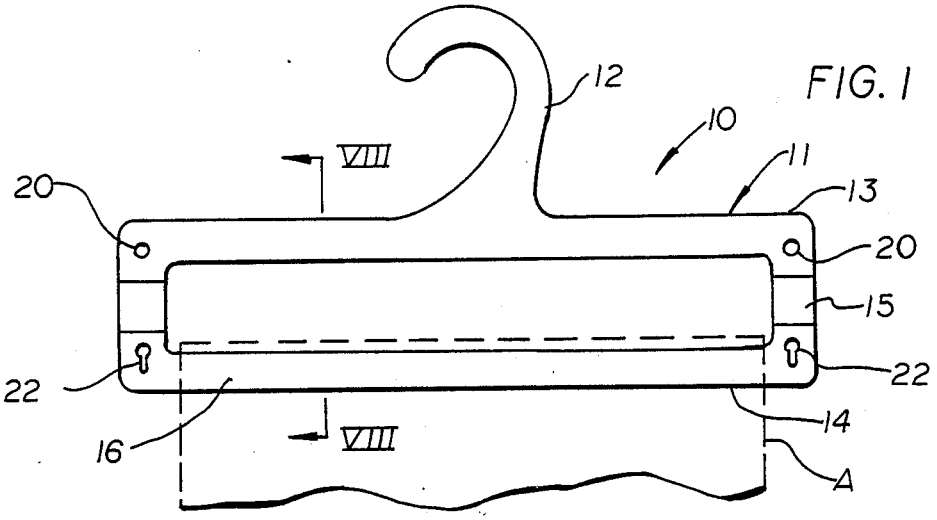
FIG. 1 is a front elevation view of a hanger incorporating this invention with a garment, illustrated in phantom, draped over the garment bar and the bar in open position.

Referring to FIG. 1, the numeral 10 identifies a hanger having an elongated body 11 supported at its center by a hook 12. The hook and body preferably are molded from plastic as a one-piece, integral structure. However, it is possible to provide a wire hook which can be secured to the body in any of the conventional manners well-known for securing metal hooks to molded plastic hangers.

The body 11 includes an upper body member 13 and a lower body member 14 integrally joined by straps 15 at each end. The entire straps or positions of the straps are of lesser thickness than the upper and lower body members to facilitate flexing when the body is folded. The lower body member can be of somewhat lesser thickness than the upper body member and thereby avoid unnecessary use of material. The lower body member is of the same length as the upper body member, thus, providing a bar between the straps 15 over which a garment can be draped. The strength and rigidity of the lower body member can be somewhat less than that of the upper body member because the weight of the garment is distributed along the length of the lower body member, whereas the upper body member must sustain this weight imposed entirely at its ends.

FIGS. 5, 6 and 8 illustrate the fact that the hinge between the upper and lower body members 13*a* and 14*a* may be joined by a web 15*a* of reduced thickness to form the hinge.

Figure 3:
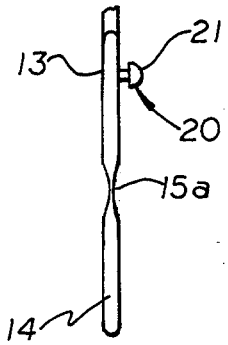
FIG. 3 is a fragmentary elevation end view of the hanger with the bar in open position.
Figure 4:
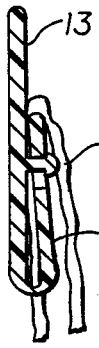
FIG. 4 is a sectional elevation view taken along the plane IV—IV of FIG. 2.

Extending forwardly from the front face of the upper bar and preferably centered above the straps 15 are a pair of pegs or anchors 20. These are molded integrally with the hanger body and each has an enlarged head 21 spaced a short distance from the front face of the upper bar by its support spindle (FIGS. 3 and 4). These cooperate with the key hole slots 22 in the ends of the lower bar and secure the lower bar when it is folded up against the upper bar as shown in FIG. 4.

When used at a retail establishment to display garments, such as slacks or pants, the hanger will normally be used in the unfolded or open position illustrated in FIG. 1. The garment A will be draped over the bar 16 of the lower body member. In this condition, removal of the garment and its return to the hanger are simple operations.

Figure 2:
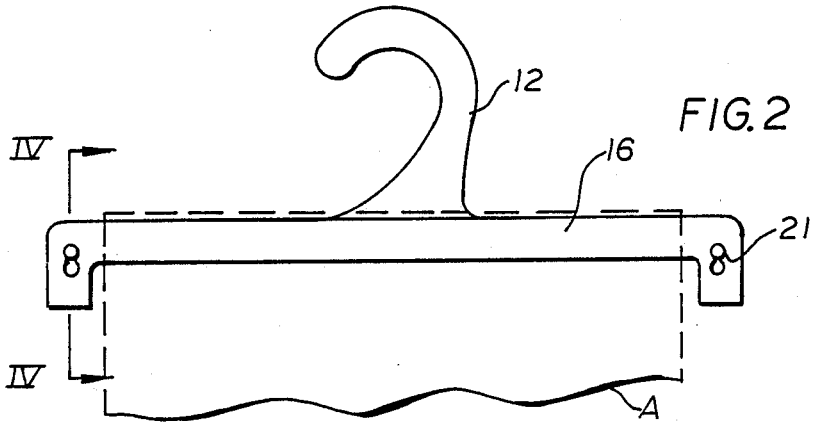
FIG. 2 is a front view of the hanger and garment illustrated in FIG. 1 after the bar has been folded into clamping position.

When the hanger is to be used for shipment and a more positive support of the garment is necessary, after the garment has been draped over the lower bar as shown in FIG. 1, the lower bar is folded upwardly parallel to the front face of the upper bar as shown in FIGS. 2 and 4. When the lower bar is adjacent the upper bar, the heads of the anchors 20 are aligned with and can be made to pass through the enlarged portions of the keyhole slots 22. The lower bar can then be shifted downwardly over the spindles of the anchors to secure the lower bar. This presses the lower body member toward the upper body member, clamping the garment between them. Thus, the garment is positively gripped by the hanger to resist release due to vibration and jolting during transport. This provides assurance that the garment will remain on the hanger until it reaches its destination.

To avoid creasing the garment by seating it over relatively narrow web edges of the lower body member, these edges 25, both top and bottom, may each be rounded as shown in FIG. 8. If wider front to back garment support is desired to avoid possible creasing, the lower bar 16*a* can be molded with even top and bottom heads or lips extending the length of the lower bar. These modifications will not require the addition of substantial material nor will they complicate molding. The length of the stems for the anchors 20 should be such that the lower body member can be folded and secured in clamping position without undue effort on the part of the operator yet still exert a positive pressure against the garment.

A further modification is that of replacing the anchors 20 and keyhole slots with a pair of horizontal slots 30 in the upper body which open through the ends of the anchor body (FIG. 5). These slots cooperate with the latch elements 31 molded integrally into the ends of the lower body member. When the lower body member 14*a* is folded against the upper body member 13*a*, the latch elements can be flexed outwardly sufficiently to enter the slots 30 and then moved inwardly to seat behind the catches 32.

In the case of the constructions illustrated in FIGS. 1–8, the folding of the hanger is made possible by the hinges 15 and 15*a* which are integral webs of the plastic material from which the rest of the hanger is made. These webs are areas of reduced thickness. Their vertical width depends upon the space which should be provided between the upper and lower bars when they are folded to accommodate the garment clamped between them. While a positive clamping pressure is necessary for positive retention, it should not be such as to crease the garment. Also, unnecessary pressure makes it difficult to latch and unlatch the lower bar from the anchors 20.

Since the hanger incorporates so-called living hinges at each end and, while being capable of sustaining the weight of a garment suspended from the lower bar without bending, the hinges must allow enough flexure to permit the anchors 20 to be mounted in their cooperating slots or the latch elements 31 to be flexed to be seated in the slots 30 and behind the catches 32. For this purpose, a particularly suitable material from which to mold this hanger is polypropylene. Polypropylene is also particularly suitable for this product because it is capable of limited flexing as it is removed from the mold so that the hangers can be removed without the use of slides or the like to effect release but at the same time be capable of returning to their molded shape without loss of memory. Polypropylene is a material capable of this type of flexure when first removed from the mold with sufficient memory to return to its molded shape and complete its cure as so shaped.

FIG. 9 illustrates another construction for this invention. In this construction, the upper body member 13*b* at each end has a forwardly extending, T-shaped latch finger 50, the head 51 of which extends lengthwise of the hanger on each side of the vertical leg 52. The leg 52 is integral with the upper body member. In a fore and aft direction, the sides of the head are aligned with openings 53 through the body member 13*b* on each side of the leg 52 whereby the head can be molded without the necessity for moveable cams.

The lower body member 14*b* has a blind slot 54 extending from what is its lower edge when folded into closed position, as illustrated. The slot 54 extends just wide enough and high enough to accommodate the leg 52. When the latch finger 51 is seated in the slot 54. The length of the leg 52 is such as to provide the desired spacing between the body members 13*b* and 14*b* to accommodate a garment.

The upper and lower body members are connected by a thin web 56 which is integral with both body members and is of a length which forms a depending loop when the body members are folded together. The web 56 has an opening 57 aligned with the slot 54 of a size to permit the head 57 of the latch to pass through it. The width of the web 56 is such that it has sufficient strength to support the lower member and its load despite the opening 57. The web can be reinforced by use of forwardly extending ribs 58 extending inwardly with at least one on each side of the opening 57 (FIGS. 9 and 10). The number and height of these ribs can be designed to accommodate the loads to which the lower member of the open hanger can be expected to be subjected.

FIGS. 11 and 12 illustrate an alternative hinge construction. In this construction, the hinge 15*b* has a relatively stiff, U-shaped loop 18 which is joined to the upper and lower body members 13b and 14b by thinner webs 19 which provide all the flexing.

FIGS. 13–17 illustrate a further modification of the means for detachably connecting the upper and lower body members 13c and 14c in garment clamping engagement. In this case, the body members 13c and 14c are connected at each end by a thin web 60. The upper body member has a forwardly and upwardly extending hook 61 integral with the upper body member 13c at its lower end. To permit the hook 61 to be molded without use of a movable cam, the body member behind the upstanding portion of the hook has an opening 62 to permit the mold die to form the back face of the hook (FIG. 14). To strengthen the hook and compensate for the weakening effect on the opening 62, the base or foot 63 of the hook can be made thicker (FIG. 14).

The lower member has a box-like end portion 67, closed at the face which forms the bottom of the member when it is in garment clamping position except for a slot 68 of the size and location to receive the hook 61. This permits the lower body member in folded position to be supported by the upper body member with the weight of any garment holding the members in this position. For strength, the body members, except at the ends are of I-beam shape.

The invention provides a lightweight hanger having positive garment clamping capability. The hanger is relatively inexpensive because, considering its functionality, it has minimum use of plastic, is capable of being made by rapid, high-speed molding methods using relatively simple dies because no movable cams or difficult to mold recesses are involved. Thus, it is a relatively inexpensive hanger to manufacture utilizing fully automatic equipment. At the same time, the hangers are easy and simple to use.

Having described a preferred embodiment and several modifications thereof, it will be understood that other modifications can be made without departing from the principles of the invention. Such modifications are to be considered as included in the hereinafter appended claims unless these claims, by their language, expressly state otherwise.

I claim:

1. A dual purpose foldable garment hanger for both display and shipment of slacks and the like, said hanger having a unitary molded one-piece plastic body, said body having an upper support bar and a lower garment engaging bar and a pair of straps, one at each end of said bars integrally connecting said bars in vertically spaced relationship when said hanger is unfolded, the upper of said bars having a support hook for said hanger, said straps each having a hinge means between said bars whereby said straps can be folded to permit said lower bar to be pivoted upwardly and inverted and positioned in side-by-side relation to said upper bar and clamp a garment draped over said lower bar between said bars, means for detachably latching said bars together when in folded position.

2. A dual purpose foldable garment hanger as described in claim 1 wherein said hinge means is a flexible portion of each strap and said latch means has latch members on one of said bars and keeper members on the other of said bars which interengage to hold said bars in folded position.

3. A dual purpose foldable garment hanger as described in claim 2 wherein said latch members and keeper members are aligned with said straps.

4. A dual purpose foldable garment hanger as described in claim 3 wherein said latch members are T-shaped projections molded integral with and projecting from one face of one of said upper bar and said lower bar and said keeper members are keyhole shaped openings through the other of said upper and lower bars with the larger end of said openings at the upper ends thereof when the bars are in their side-by-side relationship.

5. A dual purpose foldable garment hanger as described in claim 2 wherein said keeper members include slots opening through the ends of said upper bar adjacent and parallel to the upper bar's upper edge and said latch members are fingers having enlarged heads integral with said lower bar and when flexed positioned to enter said slots when the lower bar is folded upwardly into position adjacent said upper bar for retaining said lower bar in folded garment supporting and retaining position.

6. A dual purpose foldable garment hanger as described in claim 1 wherein said straps are flexible webs.

7. A dual purpose foldable garment hanger as described in claim 1 wherein said hinge means has a U-shaped rigid portion extending away from the surfaces of said bars which are juxtapositioned when the hanger is folded, said rigid portion being positioned midway between the ends of each of said straps with said rigid portions being connected to said straps by a web portion of reduced thickness each capable of flexing and serving as a hinge.

8. A dual purpose foldable garment hanger as described in claim 1 wherein said straps are flexible webs which form dependent downwardly extending loops between the bars; an anchor member extending forwardly from the front face of the upper bar and having a head portion at its forward end, a blind slot in the lower bar, said slot opening through the edge of said bar which faces downwardly when the bar is positioned adjacent the upper bar to engage said anchor member and hold said upper bar in garment clamping position.

9. A dual purpose foldable garment hanger as described in claim 8 wherein said straps having openings communicating with the ends of said slots of a size to pass the heads of anchor members therethrough.

10. A dual purpose foldable garment hanger as described in claim 8 wherein said anchor members are each T-shaped with a supporting leg and a head portion, the head portion thereof extending lengthwise of said bar, a pair of openings in said bar, one on each side of the supporting leg whereby said hanger can be molded in a two-piece mold without movable cams.

11. A dual purpose foldable garment hanger as described in claim 1 wherein said latching means includes a forwardly extending hook integral with said upper support bar and a slot opening through the face of said lower bar which is directed downwardly when said bar is in folded position.

12. A dual purpose foldable garment hanger for both display and shipment of slacks and the like, said hanger having a unitary molded one-piece plastic body, said body having an upper support bar and a lower garment engaging bar and a pair of straps, one at each end of said bars integrally connecting said bars in vertically spaced relationship when said hanger is unfolded, the upper of said bars having a support hook for said hanger, said straps providing hinge means whereby said lower bar can be pivoted upwardly and inverted into a face-to-face position in front of the upper bar whereby a garment draped over the lower bar can be clamped between said bars, means at each end of said bars for latching said bars together in garment clamping position, said means including a hook on one of said bars and a hook receiving keeper on the other of said bars, said hook and keeper being urged into latched engagement by the weight of a garment draped over said lower bar.

* * * * *